US005758763A

United States Patent [19]

Sanda et al.

[11] Patent Number: 5,758,763

[45] Date of Patent: Jun. 2, 1998

[54] PANTOGRAPH TYPE KEYBOARD SWITCH

[75] Inventors: Yutaka Sanda, Kitagunma-gun; Seiki Katakami, Isesaki; Seigo Hasunuma, Nitta-gun, all of Japan

[73] Assignee: Hosiden Corporation, Osaka, Japan

[21] Appl. No.: 696,227

[22] Filed: Aug. 13, 1996

[30] Foreign Application Priority Data

| | | | |
|---|---|---|---|
| Aug. 17, 1995 | [JP] | Japan | 7-209683 |
| Aug. 18, 1995 | [JP] | Japan | 7-210515 |
| Aug. 21, 1995 | [JP] | Japan | 7-212168 |
| Aug. 28, 1995 | [JP] | Japan | 7-219073 |
| Dec. 13, 1995 | [JP] | Japan | 7-324765 |
| Dec. 13, 1995 | [JP] | Japan | 7-324766 |

[51] Int. Cl.[6] ..... H01H 13/20

[52] U.S. Cl. ..... 200/344

[58] Field of Search ..... 200/344, 5 A, 200/517

[56] References Cited

U.S. PATENT DOCUMENTS

| | | | |
|---|---|---|---|
| 4,433,225 | 2/1984 | Cowles . | |
| 5,382,762 | 1/1995 | Mochizuki | 200/5 A |
| 5,512,719 | 4/1996 | Okada et al. | 200/344 |
| 5,555,971 | 9/1996 | Takada | 200/344 X |
| 5,630,501 | 5/1997 | Tsay | 200/344 |

FOREIGN PATENT DOCUMENTS

| | | |
|---|---|---|
| 4-51388 | of 1992 | Japan . |
| 5-290673 | of 1993 | Japan . |
| 5-66837 | of 1993 | Japan . |
| 6-36647 | of 1994 | Japan . |
| 7-19918 | of 1996 | Japan . |

*Primary Examiner*—Renee S. Luebke

*Attorney, Agent, or Firm*—Pollock, Vande Sande & Priddy

[57] ABSTRACT

In a pantograph type keyboard switch, a leaf spring projects from a linkage member and slidably engages the underside of a keytop and the resulting reaction force is used to remove play between the keytop and the linkage member. Further, a frictional slope is formed in slide grooves in the underside of the keytop so that frictional force increases as the keytop approaches a top dead point.

13 Claims, 15 Drawing Sheets

PANTOGRAPH TYPE KEYBOARD SWITCH

BACKGROUND OF THE INVENTION

The present invention relates to a pantograph type keyboard switch for use in personal computers, word processors, and the like.

In general, it is customary in the art to employ, as a keyswitch support mechanism, a vertical sliding mechanism in which one of a tubular member and a columnar member slidably received therein at one end is fixed to a housing and the other carries a keytop fixedly secured thereon. With this vertical sliding mechanism, downward actuating force applied to the keytop at a marginal edge off center thereof creates the component of a force across the direction of vertical sliding motion of the columnar member, that is, a moment at right angles to the direction of the vertical sliding motion, which increases sliding friction and hinders smooth sliding motion of the columnar member and hence smooth keyswitch actuation.

To obviate this shortcoming, there is proposed in, for example, U.S. Pat. No. 4,433,225, a keytop levelling mechanism which comprises a pair of lever arms joined at intermediate portions thereof by a pivot to form a scissors-like linkage, the two lever arms having their upper ends slidably secured to the underside of an L-shaped keytop and their lower ends slidably secured to the keyboard housing. A plunger of a keyswitch is placed under the keytop adjacent the plane of operation of the scissors-like linkage. With such an arrangement that supports the keytop by the scissors-like linkage, the keytop is allowed to depress the plunger of the keyswitch while remaining level no matter where actuating force may be applied on the keytop surface situated above lever arms of the scissors-like linkage.

With this mechanism, however, the bottom side of the keytop drives the plunger of the keyswitch at a position which is not directly under the position where the lever arms of the scissors-like linkage support the keytop and, therefore, when actuating force is applied to the keytop at the marginal edge on the side opposite to the keyswitch with respect to the lever arms, a moment is applied to the arm coupling shaft at right angles to the axial direction thereof, increasing pivoting friction between the two lever arms. Consequently, the tactile response of the keyswitch to touch largely varies according to the keytop actuation.

A solution to this problem is proposed in, for example, Japanese Utility Model Registration Application No. 66837/93 As shown in FIG. 1, two lever arms or linkage members 6 and 7 are pivotally interconnected at intermediate portions thereof to form a pantograph linkage one linkage member 6 having its upper end slidably engaged with a sliding groove 8B in the lower surface of a keytop 8 and having its lower end pivotally engaged with a pivot bearing 3A on a keyboard housing 3, and the other linkage member 7 having its upper end pivotally engaged with a pivot bearing 8A on the underside of the keytop 8 and having its lower end slidably engaged with a sliding groove 3B in the keyboard housing 3. On a printed circuit sheet there is disposed a rubber dome 5 whose flat top is in contact with the pivotal coupling portion of the two linkage members 6 and 7 when the pantograph linkage is in its most spread position. The keytop 8 is depressed to crush the rubber dome 5, causing a conductor on the ceiling of the dome 5 to short-circuit a pair of electrodes formed on the printed circuit sheet to thereby conduct the keyswitch concerned.

In this mechanism, there are certain amounts of play in the engaging portions of the linkage members 6 and 7 and the keyboard housing 3 and in the engaging portions of the linkage members 6 and 7 and the keytop 8 (play in the heights of the sliding grooves 3B and 8B, for instance) in order to facilitate smooth sliding motion and pivotal motion in these engaging portions, respectively. Hence, the keytop clatters when actuated. Further, it makes a noise when the keyboard is lifted and tilted.

A keyboard with a pantograph structure similar to the above is proposed in Japanese Utility Model Publication No. 51388/92. Also in this pantograph structure, the two lever arms have their ends slidably and pivotally engaged with the keytop and the housing and the keytop actuation entails clattering due to play in the engaging portions. In Japanese Utility Model Application Laid-Open No. 19918/95 there is also disclosed a similar pantograph-type keytop, which poses the same problem.

In Japanese patent Application Laid-Open Nos. 290673/93 and 36647/94 there are disclosed structures in which the opening of the slide groove 8B of the keytop 8 at the side near the pivot bearing 8A is closed with a wall. With this structure, by maintaining the state in which the wall formed at one end of the slide groove 8B and the pivot bearing 8A are pressed toward each other by the shaft of the linkage member 7 and the studs of the linkage member 6 while holding the keytop 8 at the top dead point by the elasticity of the rubber dome 5, it is possible to remove rattling of the keytop. Since the slide grooves 8B are closed at both ends, however, the two arms of the linkage member 6 need to be bent inwardly when the studs of the linkage member 6 are fitted into the slide grooves 8B; hence, much skill and much 5 time are required for assembling the linkage members 6 and 7 with the keytop 8.

SUMMARY OF THE INVENTION

It is therefore an object of the present invention to provide a pantograph type keyboard switch which is easy to assemble and does not much rattle during keyswitch actuation or during transportation.

In accordance with the present invention, a keyboard switch is provided which comprises:

- a board section having switches formed in a one-to-one correspondence with keys;
- an elastically deformable dome-like member disposed on the top of the board section opposite one of the switches, for turning on and off the switch;
- a pair of first pivot bearing sections and a pair of first slide grooves formed on the top of the board section around the dome-like member;
- a keytop disposed above the dome-like member and having a pair of second pivot bearing sections and a pair of second slide grooves formed in its back surface;
- first and second linkage members provided between the keytop and the board section in a one-to-one correspondence with the switches and having their lower ends received in the first pivot bearing sections and the first slide grooves and having their lower ends received in the second slide grooves and the second pivot bearing sections, respectively, the first and second linkage members being pivotally joined at intermediate portions thereof to form a pantograph; and
- press means disposed in contact with the flat top surface of the dome-like member substantially at the center of one of the first and second linkage members, for press-deforming and releasing the dome-like member in response to the actuation and release of the keytop.

According to a first aspect of the present invention, the second sliding grooves are open at one end but closed at the other end and the first linkage member has a spring mounted thereon which makes elastically sliding contact with the back surface of the keytop to produce an elastic repulsion between the keytop and the first linkage member at all times.

According to a second aspect of the present invention, the second sliding grooves are open at one end but closed at the other end and there is provided in each of the second sliding grooves frictional engaging means which frictionally engages a stud projecting out from the upper end of the first linkage member as the keytop approaches top a dead point.

According to a third aspect of the present invention, the second sliding grooves are open at one end but closed at the other end. The pair second slide grooves are open at one end on the side opposite to the second pivot bearing sections and closed by barrier walls at the other end so that when the keytop is at the top dead point, the barrier walls and the second pivot bearing section formed on the underside of the keytop are elastically pressed toward each other by studs of the first and second linkage members due to the elasticity of the dome-like member.

DESCRIPTION OF THE PREFERRED EMBODIMENTS

First Embodiment

Figure 1:
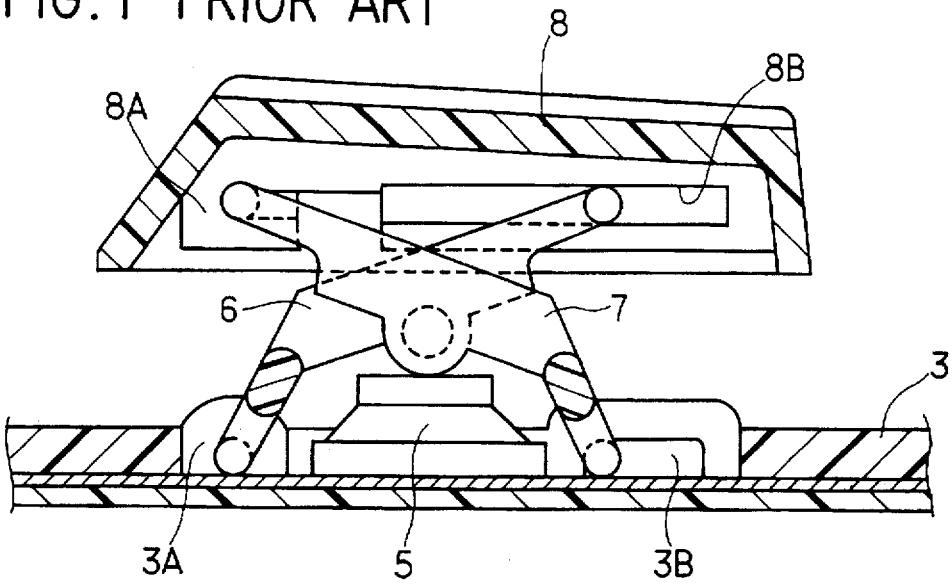
FIG. 1 PRIOR ART
FIG. 1 is a sectional view showing the construction of a conventional keyboard switch.
Figure 2:
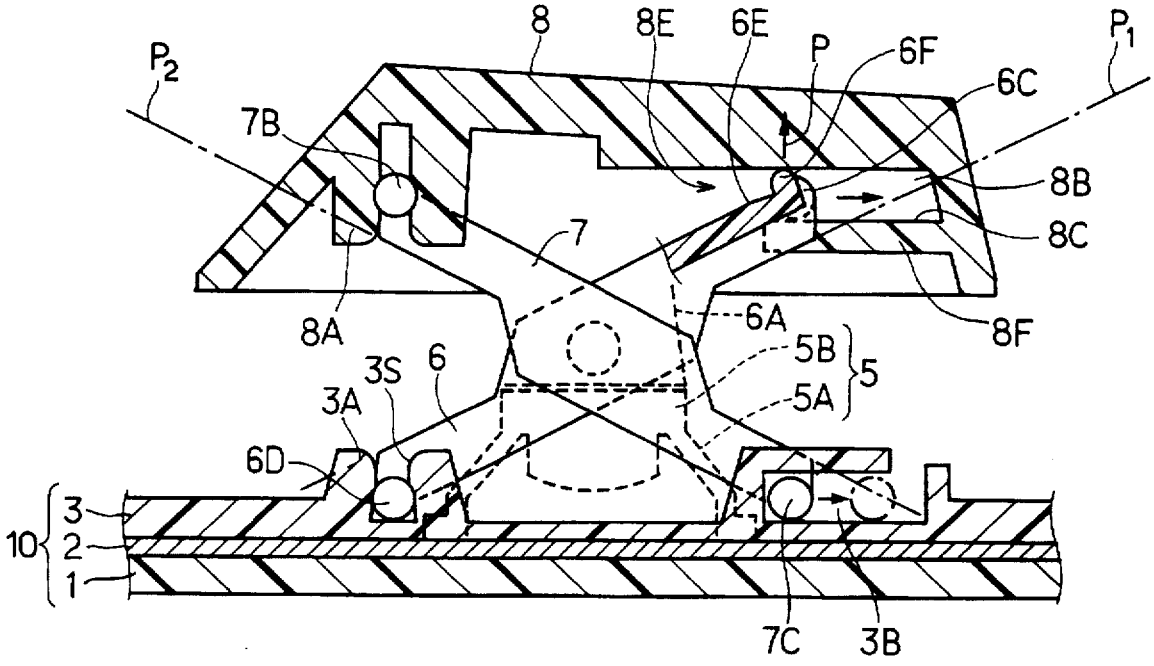
FIG. 2 is a sectional view illustrating a first embodiment of the keyboard switch according to the present invention.
Figure 3:
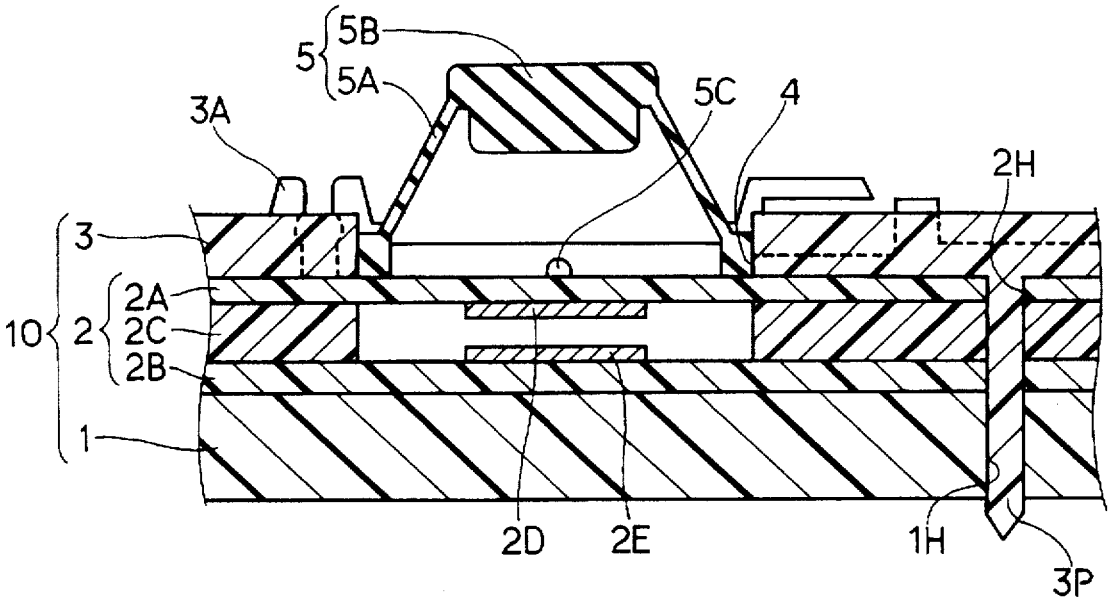
FIG. 3 is an enlarged sectional view of a switch section of the first embodiment.

FIG. 2 illustrates a first embodiment of the keyboard switch according to the present invention. Reference numeral 1 denotes a backing board, which has a membrane sheet 2 laminated thereon. The membrane sheet 2 comprises, as shown in FIG. 3, a pair of opposed insulating sheets 2A and 2B spaced a predetermined distance apart by a spacer 2c interposed between them and has conductive patterns 2D and 2E formed on the opposed surfaces of the insulating sheets 2A and 2B. The conductive patterns 2D and 2E form a contact and, by depressing the upper insulating sheet 2A from above, the conductive patterns 2D and 2E are brought into contact with each other to thereby generate a contact signal.

Figure 4:
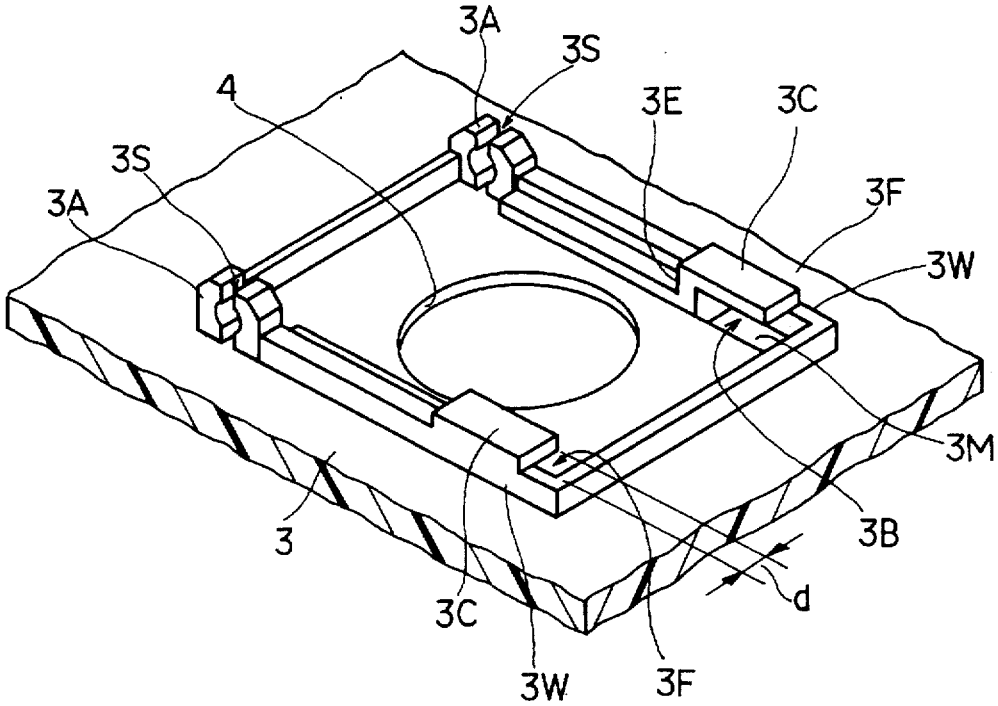
FIG. 4 is a perspective view of a housing in the first embodiment.

Reference numeral 3 denotes a housing laminated on the top of the membrane sheet 2. In FIG. 4 there is shown only an area on the keyboard housing which corresponds to one keytop. The backing board 1, the membrane sheet 2 and the housing 3 are laminated in this order to form a board section 10. Projecting downward from the underside of the housing 3 at both right- and left-hand ends of the keyboard and centrally thereof are pins 3P for positioning the membrane sheet 2 and the housing 3. The positioning pins 3P are engaged with positioning holes 2H made in the membrane sheet 2 to determine the positional relationship between the membrane sheet 2 and the housing 3, while at the same time the pins 3P pass through holes 1H made in the backing board 1. The housing 3 has a circular dome-like member receiving hole 4 (see FIG. 3) made therein opposite that area of the membrane sheet 2 where the contact is formed, and a dome-like member 5 made of an elastic material such as silicone rubber is placed in the hole 4. The dome-like member 5 comprises, as shown in section in FIG. 3, a skirt 5A collapsible in the vertical direction and a flat-topped push-button section 5B formed at the top of the skirt 5A. Reference numeral 5C denotes an air hole.

On the top surface of the housing 3 there is formed integrally therewith a square peripheral wall 3W which surrounds the hole 4. At opposite ends of a first side of the square peripheral wall 3W there are formed pivot bearing sections 3A projecting upward from the top surface of the housing. The pivot bearing sections 3A each have a slot 3S wide at its intermediate portion for receiving a stud 6D and formed in parallel with the first side of the peripheral wall 3W. The peripheral wall 3W prevents dust, liquid or similar foreign substance from entering into the dome-like member receiving hole 4 through openings between keytops. Along opposed third and fourth sides of the peripheral wall 3W which extend from opposite ends of a second side facing the first one, there are formed sliding bearing sections 3D each composed of a lug 3C protruding inwardly from the top of the peripheral wall 3W and a buffer wall 3E extending from one end of the lug 3C nearer to the bearing section 3A to the housing surface, each sliding bearing section having an inverted L-shaped cross-section. The inner side of each sliding bearing section 3D with respect to the peripheral wall 3W is open to form a slide groove 3B. The surface area of the housing 3 facing each lug 3C is a recess 3M, which forms part of the slide groove 3B.

Figure 5A:
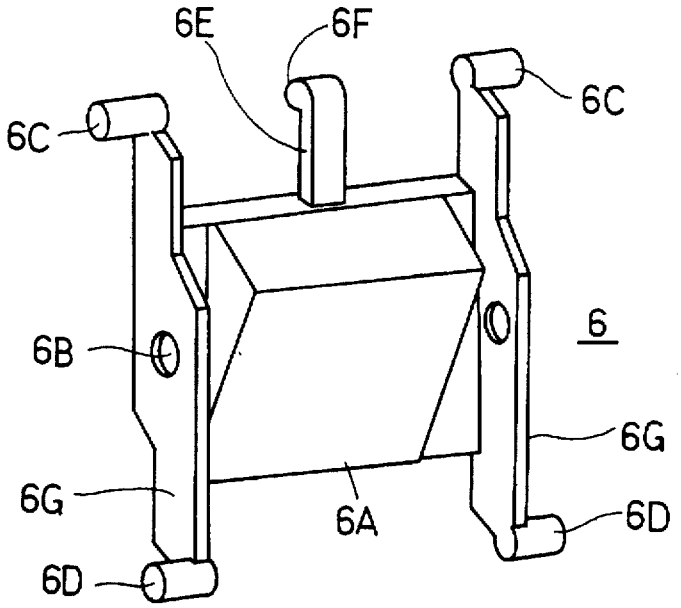
FIG. 5A is a perspective view of one of two linkage members in FIG. 2.
Figure 5B:
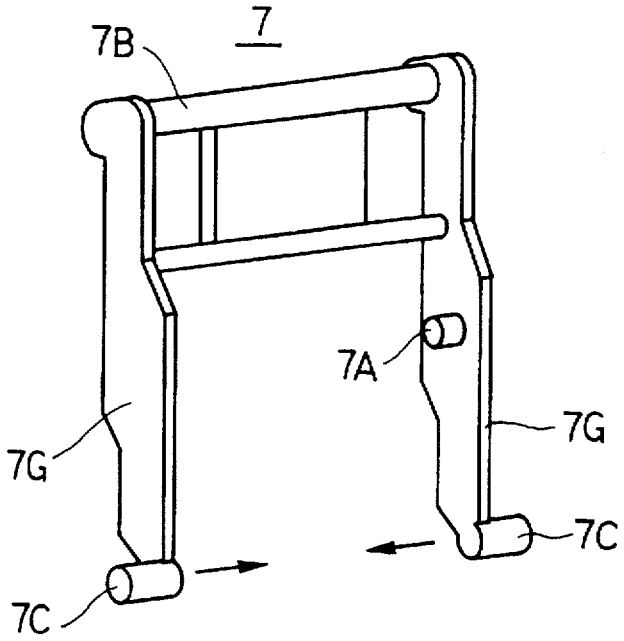
FIG. 5B is a perspective view of the other linkage member.

Reference numerals 6 and 7 denote a pair of linkage members, which are shown in FIGS. 5A and 5B, respectively. The linkage member 6 has centrally thereof a wedge-shaped press means 6A for pressing the dome-like member 5 and a pair of parallel flat arms 6G formed opposite one another the press means 6A. Studs 7A, which extend inwardly from two parallel arms 7G of the other linkage member 7 centrally thereof, are pivotally received in holes 6B made in the two arms 6G centrally thereof to form an X-shaped pantograph linkage.

The two arms 6G of the linkage member 6 have pairs of studs 6C and 6D extending outwardly from their upper and lower ends. The two arms 7G of the linkage member 7 are joined by a coupling shaft 7B at their upper ends and have a pair of studs 7C extending outwardly from their lower ends.

As shown in section in FIG. 2, the keytop 8 is substantially square, shallow cap-shaped (like a frustrum of quadrangular prism) and has on the inside thereof a pair of Divot bearing sections 8A and a pair of slide grooves 8B formed adjacent its four corners. The pivot bearing sections 8A are each defined by a pair of opposed downward extensions from the underside of the keytop 8. The slide grooves 8B are each defined by a shelf 8F extending inwardly from the inner wall of the keytop 8 toward the corresponding pivot bearing section 8A and the underside of the keytop 8. In this embodiment, the slide groove 8B has an opening 8E at its end nearer to the pivot bearing section 8A, through which the stud 6C of the linkage member 6 is pressed into the slide groove 8B in the assembling of the keyswitch.

The shaft 7B of the linkage member 7 engages the pair of pivot bearing sections 8A formed on the underside of the keytop 8 and the studs 6D of the linkage member 6 engage a pair of pivot bearing sections 3A formed on the housing 3. Coupling shaft 7B and studs 6D are pivotally received in the pivot bearing sections 8A and 3A, respectively. On the other hand, the studs 6C engage the pair of horizontal slide grooves 8B cut in the underside of the keytop 8 and the studs 7C of the linkage member 7 engage the pair of horizontal slide grooves 3B cut in the housing 3. In this state, the slope of the wedge-shaped press means 6A of the linkage member 6 is in contact with the flat top surface of the push-button section 5B of the dome-like member 5 in parallel therewith and, by the elasticity of the dome-like member 5, the linkage members 6 and 7 are held in their raised position, that is, the keytop 8 is held at a top dead point.

In the first embodiment, the linkage member 6 has a leaf or flat spring means 6E extending from the upper edge of the press means 6A between and in parallel to the arms 6G. The tip of the spring means 6E is held in contact with the underside of the keytop 8 as shown partially in section in FIG. 2, by which a reaction force is applied to the keytop 8.

In the FIG. 2 embodiment, the spring means 6E is shown to have an abrasion-resistant columnar sliding portion 6F protrusively provided on its tip. The sliding portion 6F extends upwardly above the studs 6C so that when the studs 6C are inserted in the slide grooves 8B, it abuts against the underside of the keytop 8 and slightly elastically deforms the spring means 6E, generating a reaction force P as depicted in FIG. 2.

By applying the reaction force to the keytop 8 through utilization of the spring force of the spring means 6E provided as shown in FIGS. 2 and SA, the stud 6C in each slide groove 8B is pressed against the top surface 8C of the shelf 8F forming part of the groove 8B and is held in a play-free state. By setting the reaction force P of the spring means 6E to be larger than the reaction force of the dome-like member 5, the stud 6C can be pressed against the top surface 8C of the shelf 8F during keyswitch actuation. Since the slide grooves 8B of the keytop 8 are open at one end, the studs 6C can easily be inserted into them without bending the arms 6G of the linkage member 6.

Second Embodiment

Figure 6:
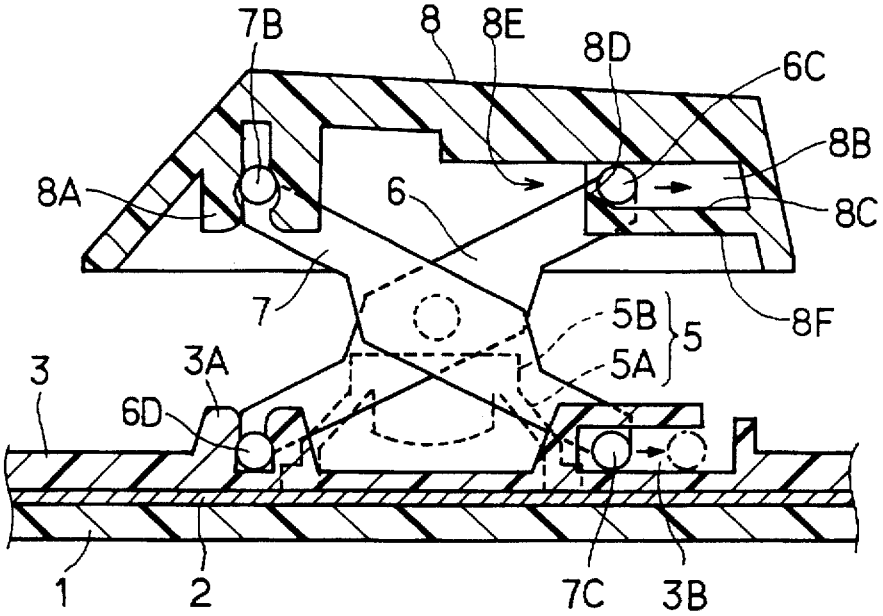
FIG. 6 is a sectional view illustrating a second embodiment of the keyboard switch according to the present invention.
Figure 7:
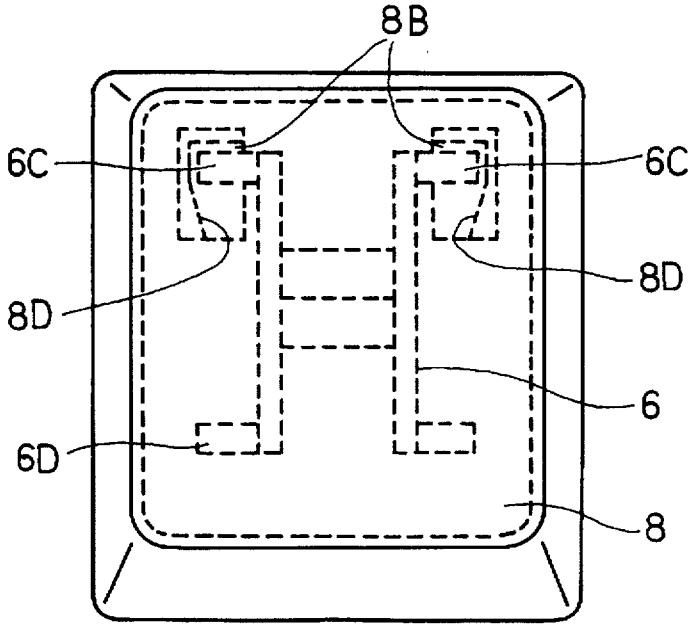
FIG. 7 is a plan view of a keytop, showing a modified form of the FIG. 6 embodiment.

FIG. 6 illustrates a second embodiment of the present invention. In the inner wall surface of each slide groove 8B near its open end portion 8E, there is formed an engaging slope 8D for frictional engagement with the stud 6C in such a manner that the groove 8B becomes narrower toward the opening 8E. In this embodiment, the engaging slope 8D is shown to be formed in the top surface of the shelf 8F forming the slide groove 8B. The engaging slope 8D is inclined in a direction in which the frictional force increases as the keytop 8 approaches the top dead point. That is, as the keytop 8 approaches the top dead point, each stud 6C moves upward on the engaging slope 8D and is ultimately forced into the space defined by the top surface 8C of the shelf 8F and the ceiling of the groove 8B opposed thereto. As a result, when the keytop 8 is at the top dead point, the studs 6C are each firmly retained in the narrow portion of the slide groove 8B, by which the keytop 8 is held rattle-free. Also in this embodiment, the spring means 6E may be added to the linkage member 6 as shown in FIG. 5A FIG. 7 shows the case where the engaging slope 8D is formed in one side wall surface of each slide groove 8B so that the tip end face of the stud 6C engages the slope 8D as it approaches the coupling shaft 7B. Also in this instance, as the keytop 8 approaches the top dead point, the frictional force between the tip of the stud 6C and the engaging slope 8D gradually increases, supporting the keytop 8 in the rattle-free state. Incidentally, the slide grooves 8B are usually cut in the underside of the keytop 8, facing each other.

Third Embodiment

Figure 8:
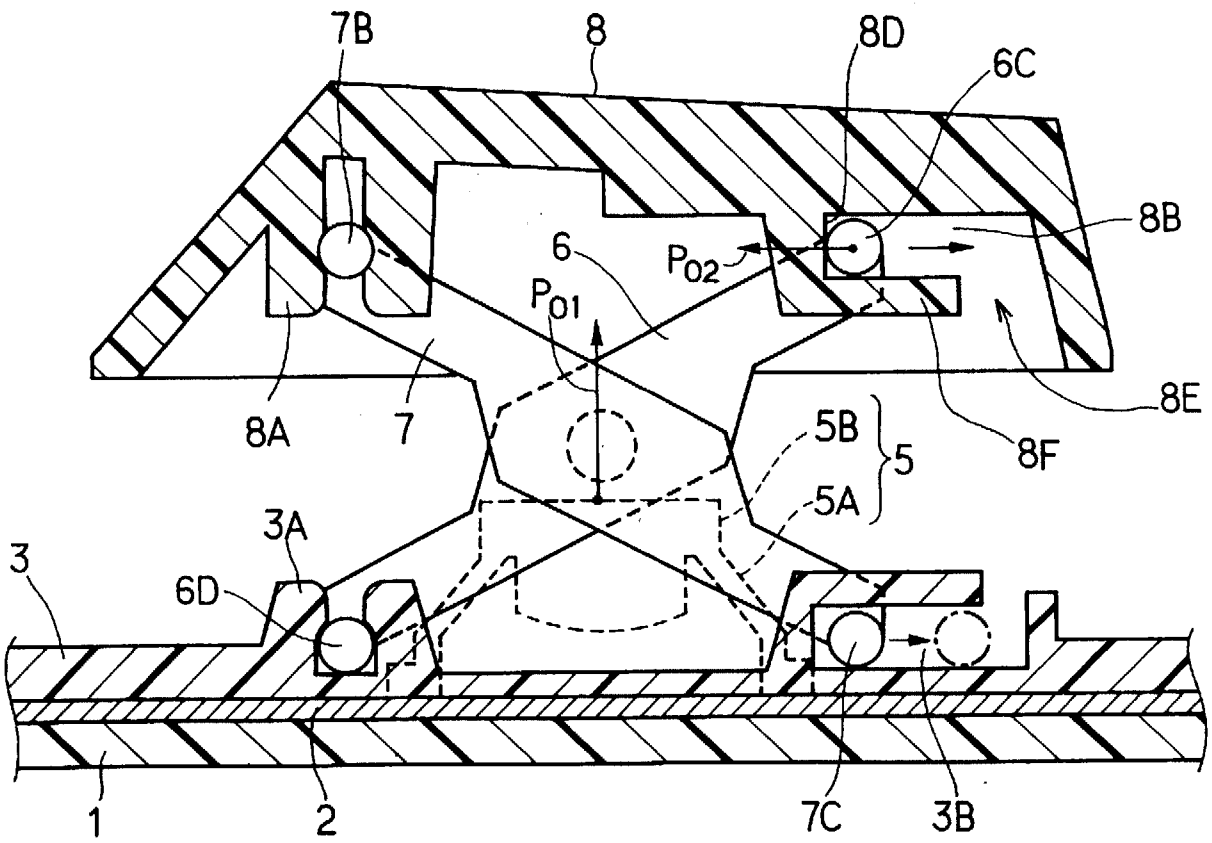
FIG. 8 is a sectional view illustrating a third embodiment of the keyboard switch according to the present invention.

FIG. 8 illustrates a third embodiment of the keyboard switch according to the present invention. In this embodiment, the slide grooves 8B for engagement with the studs 6C of the linkage member 6 each have its opening end portion 8E made on the side opposite to that in the case of FIG. 2. That is, the open end portion 8E of the slide groove 8B is formed in a direction in which the stud 6C of the linkage member 6 goes away from the coupling shaft 7B of the linkage member 7. In this embodiment, the linkage member 6 need not always be provided with such a leaf spring means 6E as shown in FIG. 5A. This embodiment is identical in construction with the first embodiment of FIG. 2 except for the direction of the open end portion 8E of the slide groove 8B. By forming the open end portion 8E of each slide grooves 8B outward with respect to the center of the keytop 8 as mentioned above, a barrier 8D can be formed at the other end of the slide groove 8B nearer to the pivot bearing section 8A. By applying a bias pressure $P_{O1}$ from the dome-like member 5 to the pantograph linkage to press each stud 6C of the linkage member 6 against the barrier 8D when the keytop 8 is pushed up to the top dead point by the elasticity of the dome-like member 5, it is possible to maintain the state in which the studs of the linkage member 6 and the coupling shaft 7B of the linkage member 7 elastically grip therebetween the keytop 8 by a force $P_{O2}$.

By elastically gripping the keytop 8 by the bias pressure P02 as mentioned above, no play is allowed to exist between the keytop 8 and the linkage members 6 and 7, so that the keytop does not rattle when actuated.

Fourth Embodiment

In the above-described embodiments, the studs 7C protrusively provided on the lower ends of the both arms 7G of the linkage member 7 are received in the slide grooves 3B formed in the housing 3. With the keytop 8 is pushed down to its lowermost position, the distance between the studs 6D and 7c of the linkage members 6 and 7 is maximum. To prevent that the stud 7C gets out of the slide groove 3B through its open end 3F by some cause, the distance between the pivot bearing section 3A and the open end 3F is set to be slightly smaller than the maximum distance between the studs 6D and 7C. Hence, to engage the studs 7C with the slide grooves 3B positioned facing each other, it is necessary that the arms 7G of the linkage member 7 be bent inwardly as indicated by the arrows in FIG. 5B to insert the studs 7C into the slide grooves 3B beyond inner marginal edges of the lugs 3C (FIG. 4) parallel to the peripheral wall 3W.

When the arms 7G of the linkage member 7 are bent toward each other in excess of the elastic limit, there is a fear that what is called a whitening phenomenon occurs, appreciably decreasing the mechanical strength of the arms 7G. In particular, when keys are miniaturized, the arms 7G become so short that they would very likely to be broken down if bent in excess of the length of inward protrusion d of each lug 3C.

Figure 9:
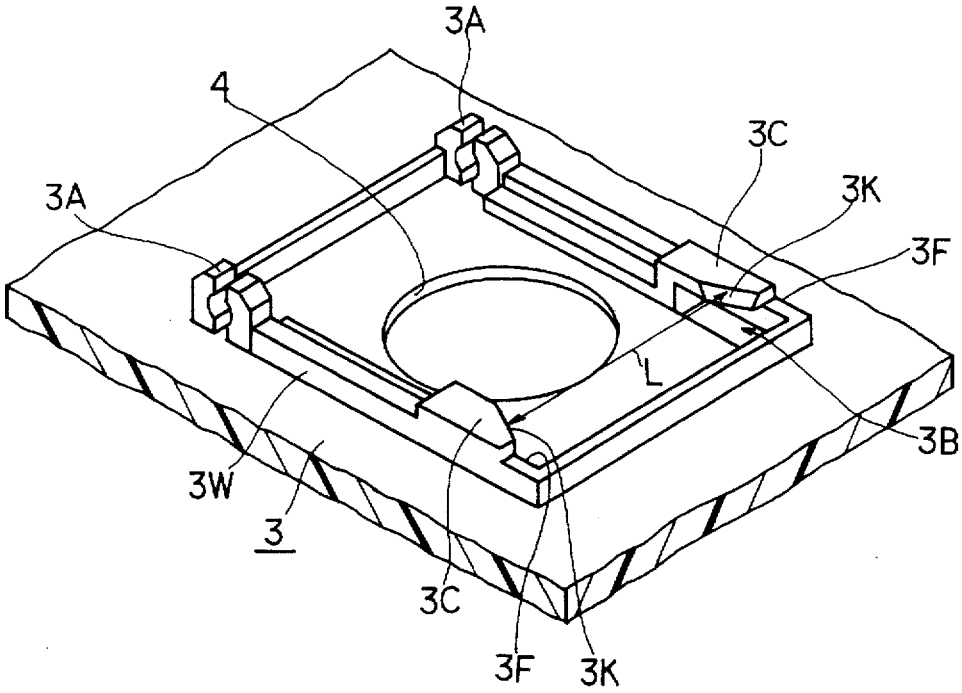
FIG. 9 is a perspective view of the housing in a fourth embodiment of the present invention.

In the keyboard switch of this embodiment in which the pantograph mechanism of FIGS. 2, 6, or 8 is used to support the keytop 8 in a manner to be movable up and down, as shown in FIG. 9 the lugs 3C for forming the slide grooves 3B have their inner corner portions cut away just above the open ends 3F of the slide grooves 3B to form guide slopes 3K so that the distance L between the opposed lugs 3C gradually increases toward the open end 3F of each slide groove 3B but decreases as the lower edges of the slopes 3K are approached. This embodiment is identical in construction with the FIG. 4 embodiment except for the provision of the guide slopes 3K.

Figure 10:
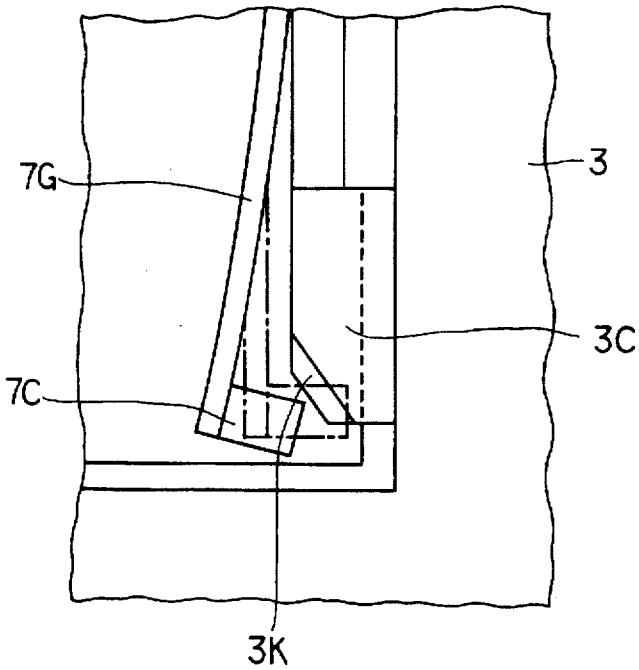
FIG. 10 is a plan view showing the relationship between a slide groove and a linkage member, for explaining the operation of the fourth embodiment.

With such an arrangement, the studs 7C of the arms 7G can be slid down on the guide slopes 3K and into the slide grooves 3B as depicted in FIG. 10. Accordingly, the studs 7C can be inserted into the slide grooves 3B without greatly bending the arms 7G of the linkage member 7. It is also possible to prevent the arms 7G from being bent in excess of their elastic limit. Further, even if the linkage member 7 becomes small in accordance with downsizing of the keytop, the studs 7C can easily be inserted into the slide grooves 3B without greatly deforming the arms 7G; hence, the miniaturized linkage member 7 can also be mounted on the housing 3 without the fear of breakage. Additionally,the provision of the guide slopes 3K permits easy assembling of the keyboard switch by an automatic assembling unit.

Fifth Embodiment

Figure 11:
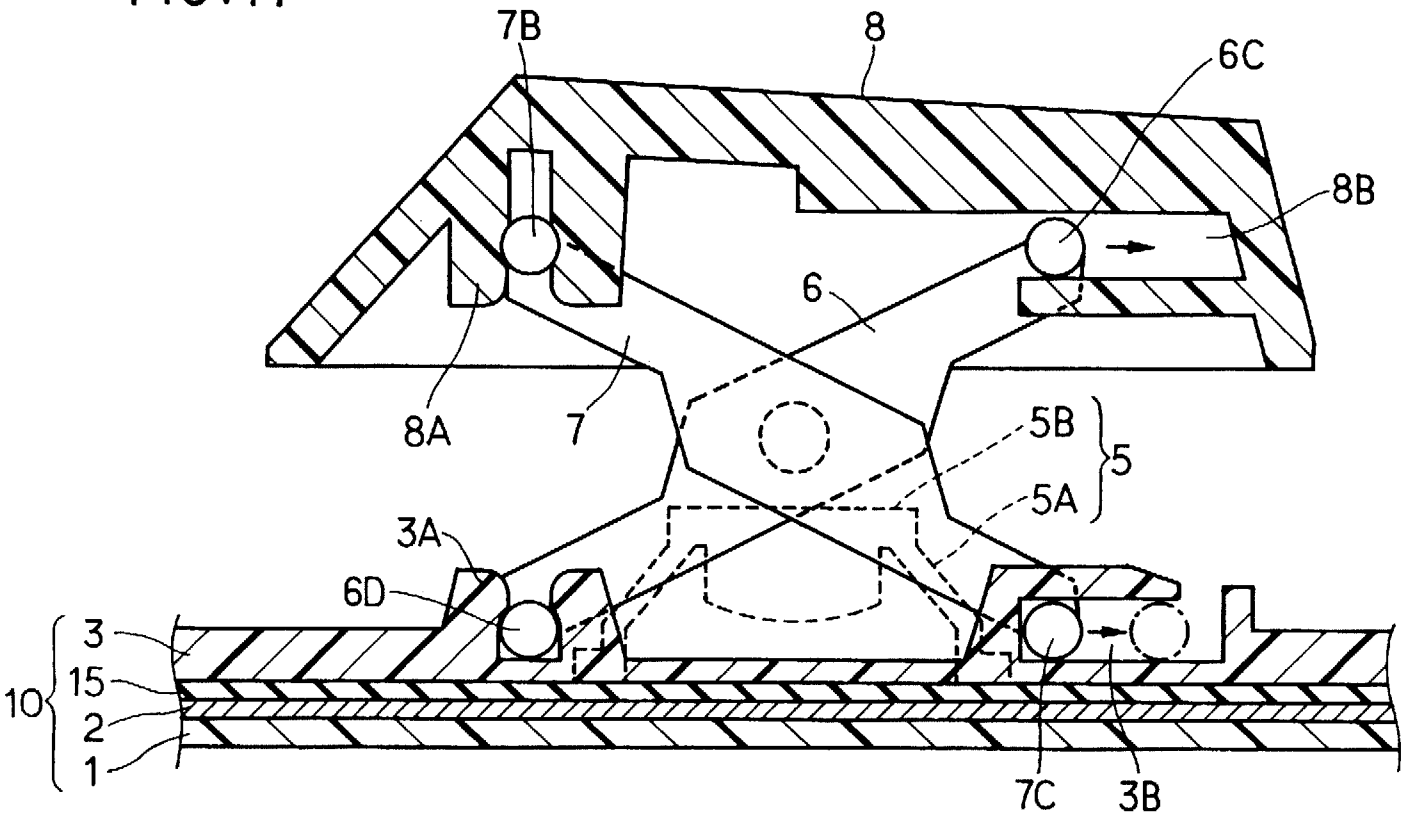
FIG. 11 is a sectional view illustrating a fifth embodiment of the keyboard switch according to the present invention.

In the keyswitch employing the pantograph mechanism, the dome-like member 5 is pressed by the press means 6A mounted on the linkage member 6 (see FIG. 5A). Since the press means 6A turns about the studs 6D, it applies a downward force and a horizontal force to the dome-like member 5. The dome-like member 5 is likely to be displaced horizontally by the horizontal force applied thereto, causing variations in the physical sensation fed back to the keyboard operator. To avoid this, in the embodiments of FIGS. 2, 6 and 8 the dome-like members 5 are each bonded to the membrane sheet 2 in the circular hole 4 and hence fixed in position. The bonding of the dome-like members 5 to the membrane sheet 2 one by one requires many fabrication steps and the assembling is cumbersome, causing an increase in the manufacturing costs. In FIG. 11 there is illustrated a fifth embodiment of the invention which solves this problem.

Figure 12:
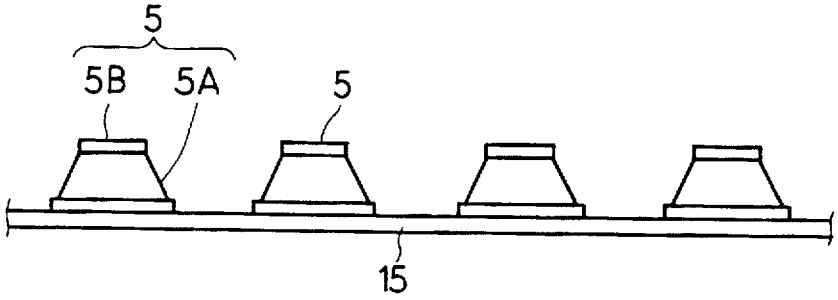
FIG. 12 shows front views of dome-like members and an elastic sheet formed integrally with each other in the FIG. 11 embodiment.

In FIG. 11, the parts corresponding to those in FIGS. 2, 6 and 8 are identified by the same reference numerals. In this embodiment, an elastic sheet 15 is formed integrally with the dome-like members 5 as shown in FIG. 12, and the elastic sheet 15 is sandwiched between the membrane sheet 2 and the housing 3 as shown in FIG. 11. The elastic sheet 15 and the dome-like members 5 can be molded from an elastic material such as silicone rubber.

With this structure, since the dome-like members 5 need not be bonded one by one to the membrane sheet 2, the number of steps involves in the assembling can be reduced; hence, the manufacturing costs could be cut accordingly. Further, since the dome-like members 5 are fixed by the elastic sheet 15, they can be disposed accurately for any keytops 8 on the keyboard. As the result of this, the dome-like members 5 apply the same reaction force to all of the keytops, ensuring the feedback of uniform physical sensation to the keyboard operator by the keytop actuation.

Sixth Embodiment

As described previously with reference to FIG. 3, the positioning pins 3P are protrusively provided on the housing 3 and are received in positioning holes 2H made in the membrane sheet 2, by which the membrane sheet 2 is positioned. The insulating sheets 2A and 2B and the spacer 2C of the membrane sheet 2 are bonded together by a pressure sensitive adhesive double coated tape or the like at their peripheral portions, but in the area where the contact is formed, they are not bonded together. On this account, there is a fear that if dirt, dust or moisture enters between the housing 3 and the membrane sheet 2 through an edge of the circular hole 4 made in the housing 3, it burrows its way into minute spaces between the insulating sheet 2A and the spacer 2C and between the insulating sheet 2B and the spacer 2C through the positioning hole 2H and ultimately into the area where the conductive patterns 2D and 2E are formed, causing bad contact therebetween.

Figure 13:
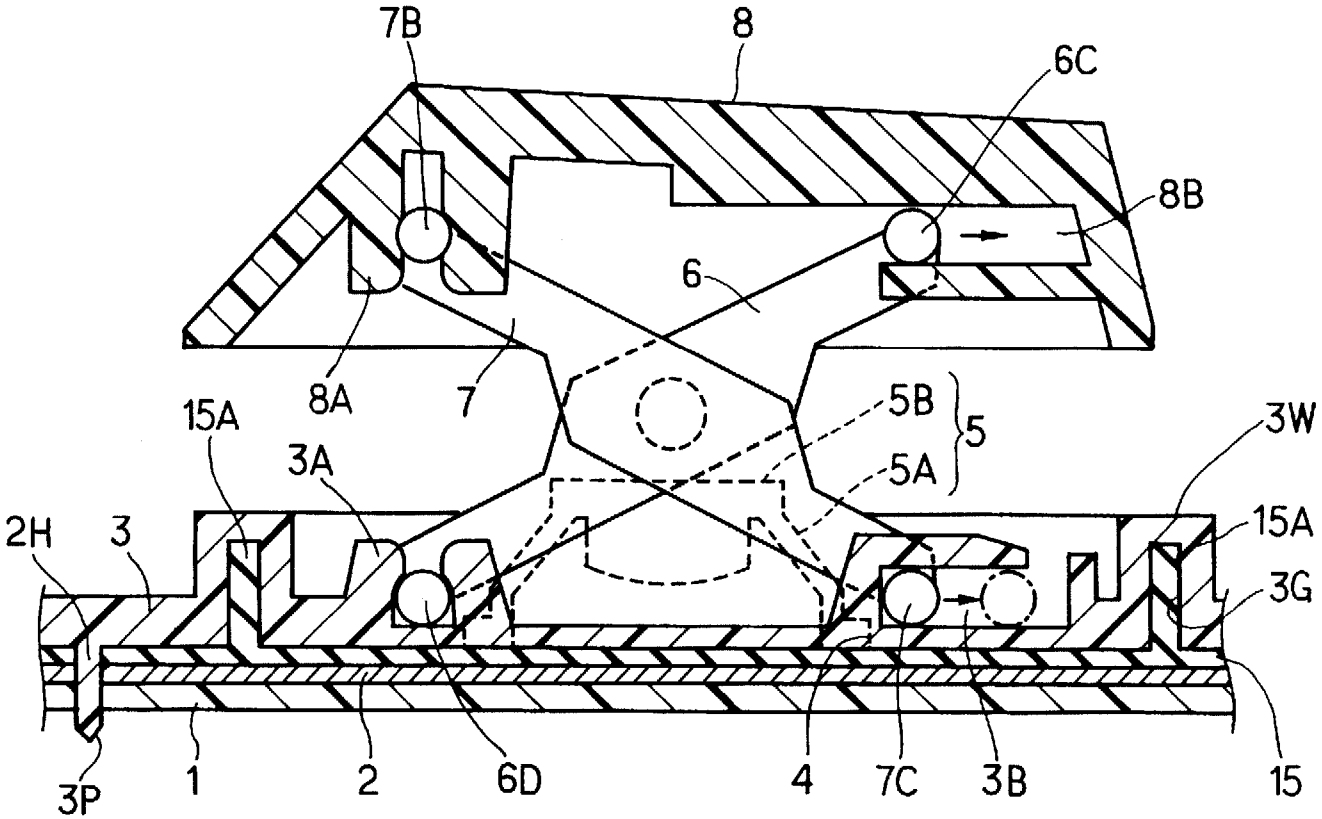
FIG. 13 is a sectional view illustrating a sixth embodiment of the keyboard switch according to the present invention.
Figure 14:
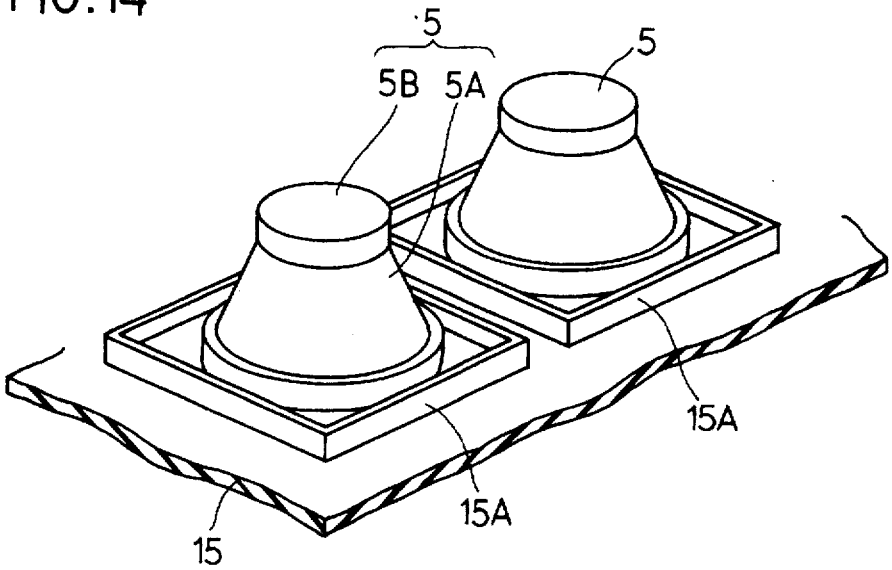
FIG. 14 is a perspective view showing frames protrusively provided on an elastic sheet around dome-like members in FIG. 13.

This embodiment is intended to simplify the mounting of the dome-like members 5 and prevent the entry of dirt or the like into the membrane sheet 2. That is, in this embodiment, as shown in FIGS. 13 and 14, a groove 3G is cut in the peripheral wall 3W from the underside of the housing 3 and a frame 15A extended from the elastic sheet 15 is fitted into the groove 3G to form a dustproof structure. In FIG. 14 there are shown the frames 15A extended from the elastic sheet 15 and the dome-like members 5. The frames 15A are molded integrally with the elastic sheet 15 around the dome-like members 5. The extended frame 15A is formed outside the pivot bearing section 3A and sliding bearing section 3B as well as the dome-like member receiving hole 4 as shown in FIG. 13.

Accordingly, the groove 3G to be cut in the underside of the housing 3 is also positioned outside the bearing sections 3A and 3B. The extended frame 15A from the elastic sheet 15 is fitted into the groove 3G.

With the construction in which the extended frame 15A molded integrally with the elastic sheet 15, which surrounds the dome-like member receiving hole 4, is fitted into the groove 3G cut in the housing 3, even if dust or the like enters through the hole 4, its further entry is prevented by the combination of the extended frame 15A and the groove 3G; consequently, dust will never reach the position of the pin 3p.

Thus, there is no possibility of dust or the like entering between the insulating sheets 2A and 2B and the spacer 2C of the membrane sheet 2 through the positioning hole 2H made in the membrane sheet 2. Hence, dust or the like will not enter the contact portion of the membrane sheet 2—this ensure that the keyboard switch stably operates for the long term.

Seventh Embodiment

Figure 15:
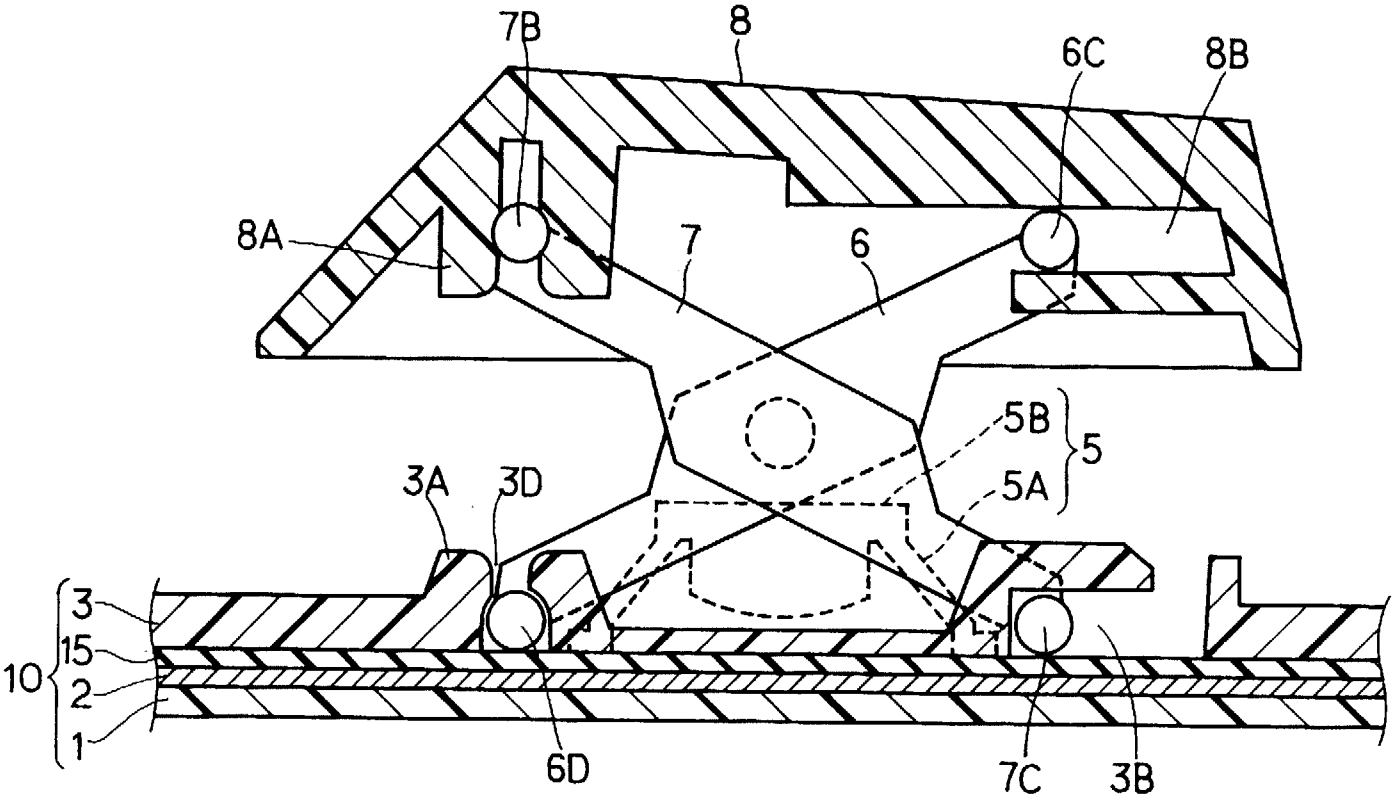
FIG. 15 is a sectional view illustrating a seventh embodiment of the keyboard switch according to the present invention.

Since the FIG. 11 embodiment employs a construction in which the dome-like members 5 are all molded integrally with the elastic sheet 15 on the top surface thereof and the elastic sheet 15 is sandwiched between the membrane sheet 2 and the housing 3, the height of the keytop 8 increases by the thickness of the elastic sheet 15. FIG. 15 illustrates a construction which avoids this problem. As depicted in FIG. 15, those portions of the housing underlying the pivot bearing section 3D and the sliding bearing section 3B are removed so that the studs 6D and 7C are received directly on the top surface of the elastic sheet 15. As a result, the height of the keytop 8 can be decreased by the thickness of the housing 3. This embodiment is identical in construction with the FIG. 11 embodiment except for the above.

In this embodiment, even if the elastic sheet 15 is interposed between the housing 3 and the membrane sheet 2, the heights of the linkage members 6 and 7 can be reduced by the thickness of the housing 3. This cancels the thickness of the elastic sheet 15 and hence suppresses an increase in the overall thickness of the keyboard.

Figure 16:
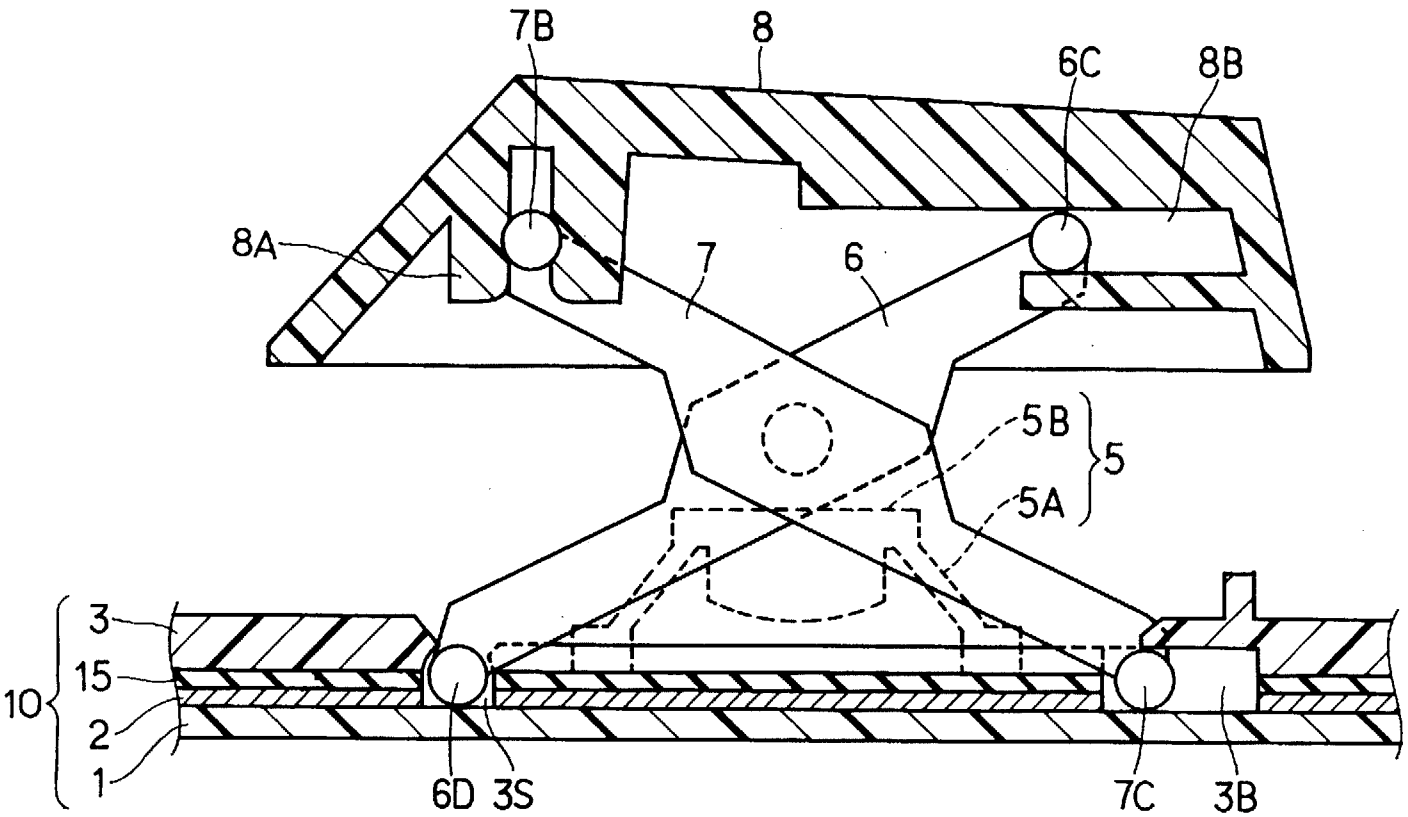
FIG. 16 is a sectional view illustrating a modified form of the seventh embodiment.

FIG. 16 illustrates a modified form of the FIG. 15 embodiment, in which the elastic sheet 15 and the membrane sheet 2 are selectively removed so that the bottoms of the pivot bearing slot 3S and the slide groove 3B are formed by the top surface of the backing board 1. That is, the elastic sheet 15 and, if necessary, the membrane sheet 2 are selectively removed to form the slot 3S and the groove 3B between the housing 3 and the backing board 1 for receiving the studs 6D and 7C of the linkage members 6 and 7. With such a construction, the heights of the linkage members 6 and 7 can be reduced by the thicknesses of the membrane sheet 2 and the housing 3. Accordingly, the overall thickness of the keyboard can be reduced. The embodiments of FIGS. 15 and 16 permit reduction of thickness of the keyboard, and hence they are suitable for application to portable electronic instruments, for instance.

Eighth Embodiment

Figure 17:
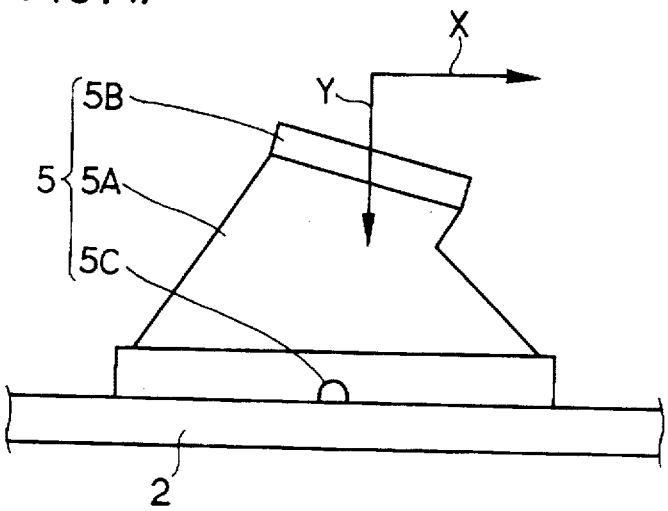
FIG. 17 is a diagram showing deformation of the dome-like member when it is pressed.

In the embodiments described above, when depressing the top surface of the dome-like member 5, the press means 6A of the linkage member 6 rotates or pivots about the studs 6D. As the result of this, a downward force Y and a horizontal force X are applied to the top surface of the dome-like member 5 as shown in FIG. 17. The frictional resistance between the press means 6A made of a resin material and the top surface of the dome-like member 5 made of rubber or the like is so great that they do not slide on each other but instead the dome-like member 5 is deformed asymmetrically as depicted in FIG. 17. This causes a defect that the tactile response of the keyswitch to touch is deteriorated. Further, the dome-like member 5 is pressed on one side, and hence is greatly deformed on that side. Consequently, the dome-like member 5 is locally fatigued, posing a problem in its durability.

Figure 18:
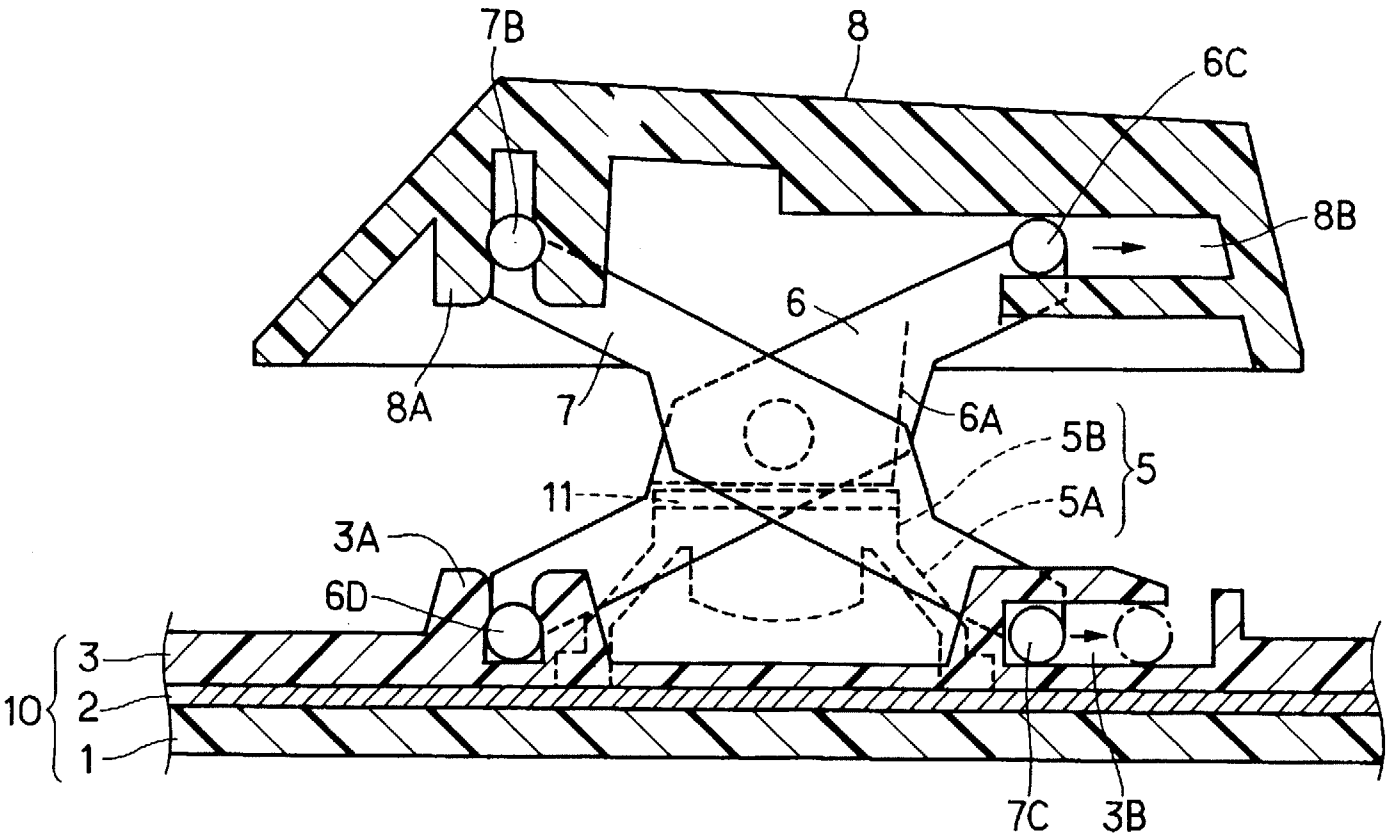
FIG. 18 is a sectional view illustrating an eighth embodiment of the keyboard switch according to the present invention.

FIG. 18 illustrates an embodiment of the keyboard switch intended to solve this problem. The parts corresponding to those in FIG. 2 are identified by the same reference numerals. In this embodiment, the flat top surface is covered with a friction reducing layer 11, which can be formed from a rigid resin material, for instance. The rigid resin material layer 11 reduces the friction between the press means 6A and the top surface of the dome-like member 5, by which the top surface of the dome-like member 5 causes slip for the component of movement of the press means 6A in the X-axis direction, reducing unbalanced deformation of the skirt portion 5A of the dome-like member 5.

Since the hard resin has a smaller coefficient of friction with other resin than rubber, the rigid material member 11 can be formed by sticking a sheet member of a hard resin material to the top surface of the dome-like member 5 with a pressure sensitive adhesive double coated tape, or by hardening an adhesive or paint coated over the top surface area of the dome-like member 5.

By providing rigidity in the top surface of the dome-like member 5 as mentioned above, the horizontal component of movement of the press means 6A by the pivotal motion of the linkage member 6 causes the press means 6A only to slide on the top surface of the dome-like member in the horizontal direction; hence unbalanced deformation of the dome-like member 5 does not occur. Thus, the press means 6A presses down the top surface of the dome-like member 5 uniformly over the entire area thereof and forces are applied uniformly to the skirt portion 5A; hence, the dome-like member 5 can receive the pressure while remaining level. Accordingly, the dome-like member 5 is not locally deformed and its durability can be increased. Since the dome-like member 5 receives the downward pressure while remaining level, the degradation of the tactile response of the keyswitch to touch can be alleviated.

In the embodiment of FIG. 18, a lubricant such as grease may be coated over the entire area of the top surface of the dome-like member 5 instead of using the rigid material to form the friction reducing layer 11. With the top surface of the dome-like member 5 thus made slippery, even if the press means 6A of the linkage member 6 rotates and presses down the dome-like member 5 and applies a horizontal biasing force to its top, the press means 6A smoothly slides on the top surface of the dome-like member 5 since the coefficient of friction between them is small. Although the press means 6A moves horizontally (in the X-axis direction) while rotating, the dome-like member 5 does not follow the motion of the press means 6A but is depressed vertically while remaining level. Since the frictional resistance between the top surface of the dome-like member 5 and the press means 6A is small, the sliding of the latter on the former does not affect physical sensation fed back to the keyboard operator.

Incidentally, the top surface of the dome-like member 5 can be made slippery not only by using such a lubricant as grease but also by molding the dome-like member 5 from a resin material of a small coefficient of friction, such as silicone rubber. Alternatively, the press means 6A may be formed of a resin material which has a small coefficient of friction.

Figure 19:
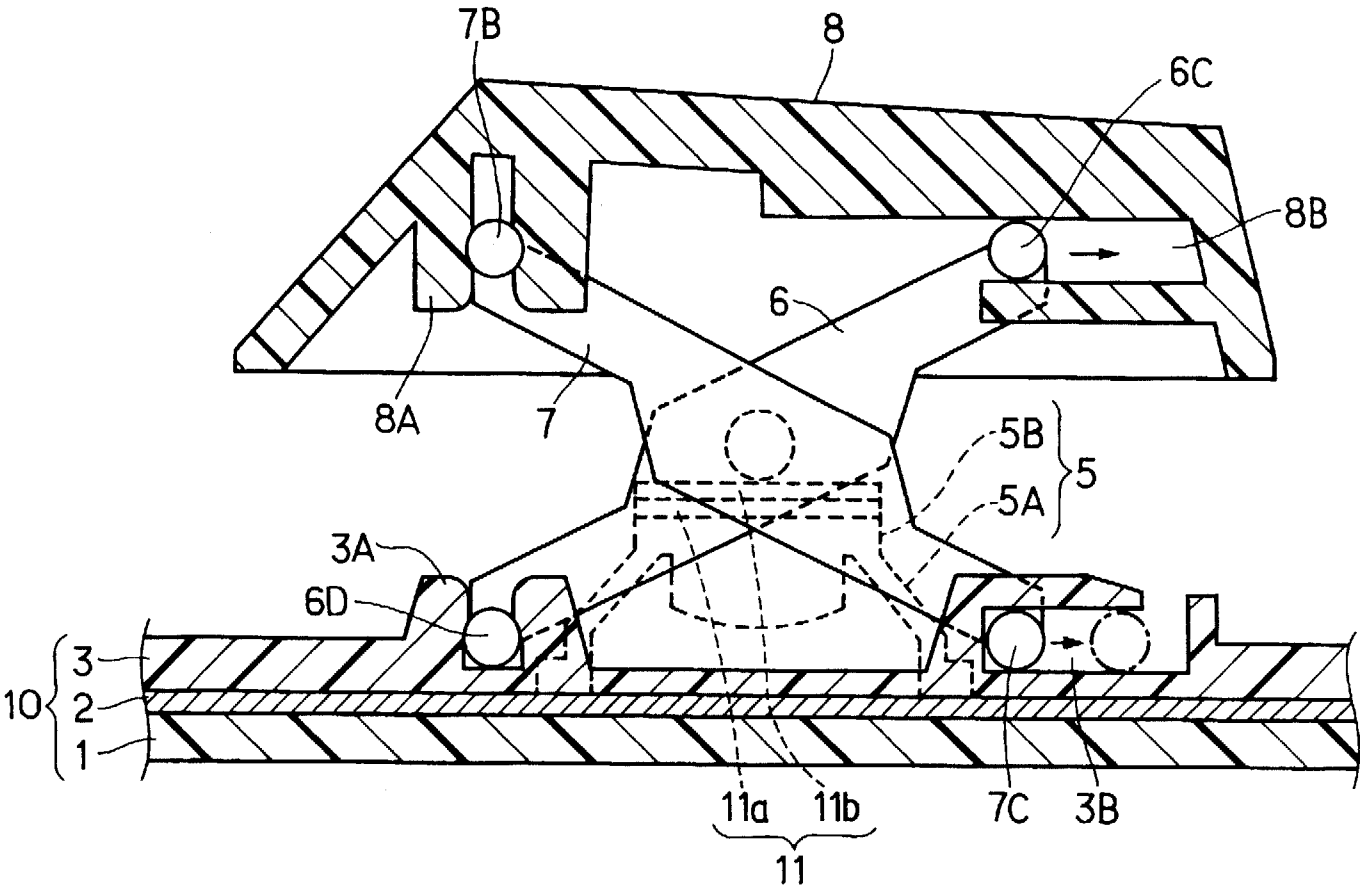
FIG. 19 is a sectional view illustrating a modified form of the eighth embodiment.

FIG. 19 illustrates a modified form of the FIG. 18 embodiment, in which the friction reducing layer 11 on the top surface of the dome-like member 5 is formed by a combination of a rigid material member 11*a* and a lubricant 11b. By providing rigidity in the top surface of the dome-like member 5 and slipperiness in the top surface thus made rigid, the dome-like member 5 is allowed to remain level with more ease with respect to the downward pressure applied thereto by the press means 6A and the physical sensation fed back to the keyboard operator can be improved accordingly. Where the rigid top surface of the dome-like member 5 is made slippery, the rigid material member 11*a* may be formed of a resin material which has a small coefficient of friction.

Figure 20:
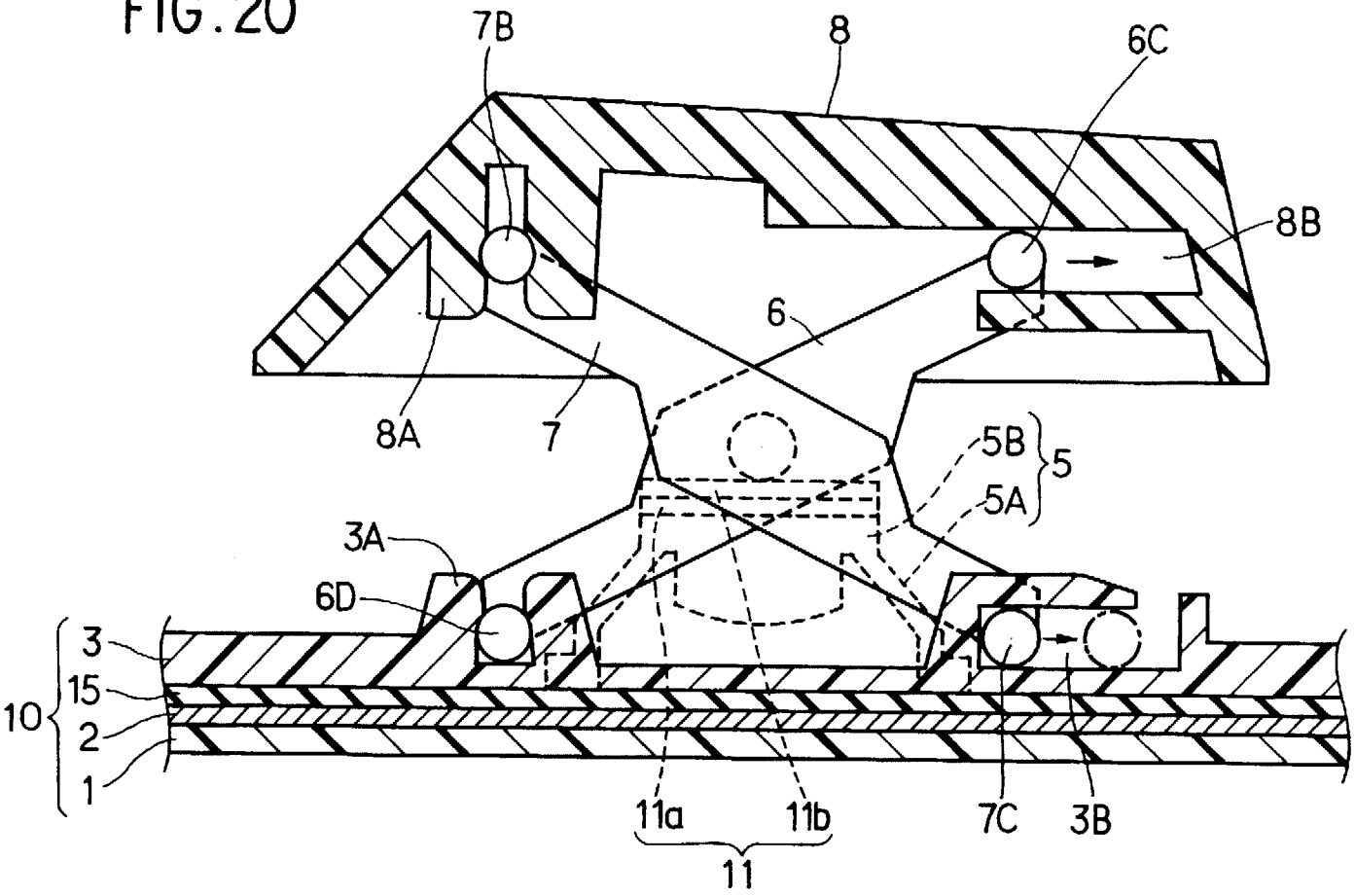
FIG. 20 is a sectional view illustrating a combination of the eighth and fifth embodiments.

FIG. 20 illustrates another modified form of the FIG. 18 embodiment, in which, in addition of the combined use of the rigid material member 11*a* and the lubricant 11b as the friction reducing layer 11, dome-like members 5 are molded integrally with the elastic sheet 15 as depicted in FIG. 12 and the elastic sheet is sandwiched between the membrane sheet 2 and the housing 3 to fix the position of each dome-like member 5 by the elastic sheet 15.

With this keyboard switch structure, the rigidity or slipperiness of the top surface of the dome-like member 5 produces the operational effect that allows the dome-like member 5 to receive the depressing force of the press means 6A while remaining level, and the position of every dome-like member 5 can be defined by the accuracy of a mold which is used for molding the dome-like members 6 integrally with the elastic sheet 15. As a result, the positions of the dome-like members of a plurality of keyboard switches on the keyboard are made uniform with respect to individual keytops 8 and reacting forces by the dome-like members can also be made uniform. Since a uniform reaction force can thus be applied to every keytop 8, the keyboard provides uniform tactile response. Further, the assembling of keyswitches is easier than in the case of bonding the dome-like members 5 one by one on the membrane sheet 12.

In FIG. 20 the top surface of the dome-like member 5 is covered with the rigid material 11*a* and the lubricant 11*b*, but even if only one of them is used, the dome-like members 5 can be molded integrally with the elastic sheet 15.

In each of the embodiments described above, the studs 6C and 6D of the linkage member 6 and the shaft 7B and studs 7C of the linkage member 7 are positioned nearer to the top of the housing 3 and the back surface of the keytop 8 with respect to the axis lines $P_1$ and $P_2$ of the linkage members 6 and 7 lengthwise thereof as shown in FIG. 2 so that the linkage members 6 and 7 do not interfere with the sliding motion of the studs 6A and 7C. Further, since the linkage member 6 has the press means 6A, it is necessary to make a check to see if the linkage members 6 and 7 are assembled on their right or wrong sides.

When the linkage members 6 and 7 are assembled together on their wrong sides, the studs 6C and 7C cannot be fitted into the slide grooves 3B and 8B. To avoid this, 4 it is general practice in the prior art that the right and wrong sides of each of the linkage members 6 and 7 are given different color coatings, but this cannot assure completely error-free assembling.

Figure 21A:
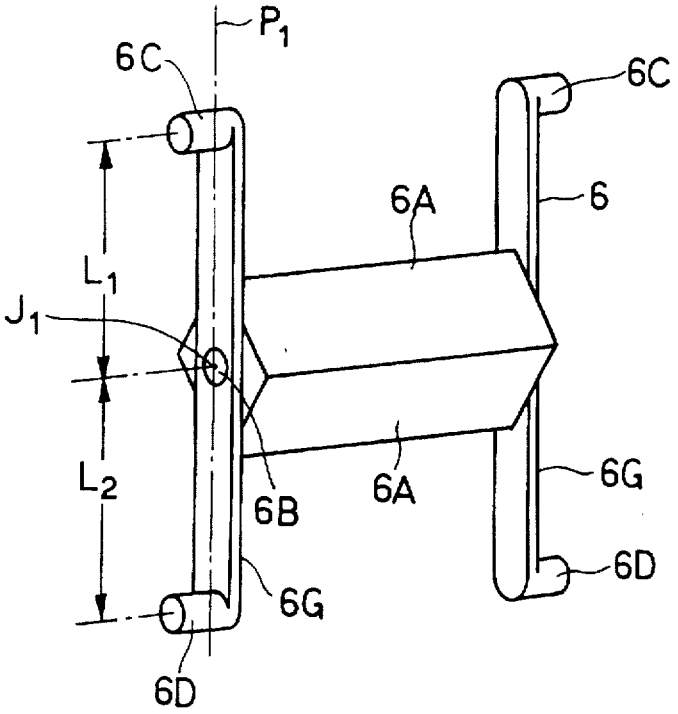
FIG. 21A is a perspective view showing a modified form of one of the linkage members of the pantograph in each embodiment.
Figure 21B:
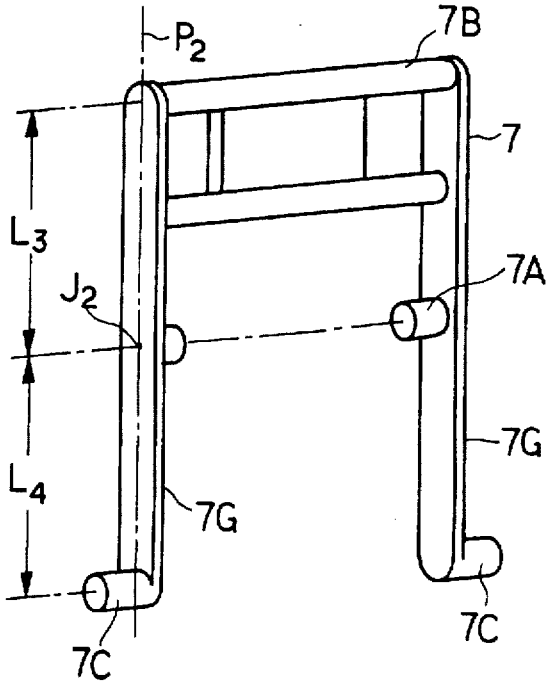
FIG. 21B is a perspective view showing a modified form of the other linkage member of the pantograph.

FIGS. 21A and 21B show examples of the linkage members 6 and 7 improved in this respect. In this case, the linkage members 6 and 7 are each formed symmetrical on the front and back thereof to ensure correct assembling of them regardless of the front-and-back relationship. To this end, each of the linkgage members 6 and 7 has a pair of plate-like flat arms joined in parallel to each other and the front and back of each of the linkage members 6 and 7 are formed symmetrical with respect to their longitudinal axis lines $P_1$ and $P_2$ passing through the axes of the studs 7A which pivotally couple the linkage members 6 and 7. Moreover, the lengths $L_1$, $L_2$, $L_3$ and $L_4$ from stud joining points $J_1$ and $J_2$ to respective ends of the linkage members 6 and 7 are all chosen to be equal, i.e. $L_1=L_2=L_3=L_4$. With such a symmetrical configuration of each linkage member, unless an error is made in engaging the shaft 7B of the linkage member 7 with the pivot bearing section 8A of the keytop 8, the linkage members 6 and 7 can be assembled together even if they are upside down or wrong side out.

EFFECT OF THE INVENTION

As described above, in the keyboard switch according to a first aspect of the present invention, the leaf spring member is added to the linkage member held in sliding engagement with the keytop, to always bias the keytop upward to thereby remove rattling of the keytop.

According to a second aspect of the invention, a frictional slope is formed in the slide groove of the keytop so that the stud of the linkage member moves into engagement with the frictional slope as the keytop approaches the top dead point, thereby removing rattling of the keytop.

According to a third aspect of the invention, the slide groove of the keytop is closed with a barrier wall at one end nearer to the pivot bearing section of the keytop and open at the other end, so that when the keytop is at the top dead point due to the elasticity of the dome-like member, the pivot bearing section of the keytop and the above-said barrier wall are gripped by the coupling shaft and the stud of the pair of linkage members, by which rattling of the keytop can be suppressed.

According to a fourth aspect of the present invention, a guide slope is formed at a corner of the open end portion of each slide groove formed in the housing, so that each stud of one of the linkage members forming the pantograph structure can be inserted into the slide groove without excessively bending the linkage member.

According to a fifth aspect of the present invention, the dome-like member and the extended frame surrounding it are molded integrally with the elastic sheet and the extended frame is fitted into a groove cut in the underside of the housing, by which it is possible to prevent dust from entering through the dome-like member receiving hole.

In any case, since the slide grooves of the keytop are open at one end, the studs of the linkage member can easily be fitted into the slide grooves. It will be apparent that many modifications and variations may be effected without departing from the scope of the novel concepts of the present invention.

What is claimed is:

1. A keyboard switch comprising:

a board section having switches formed in a one-to-one correspondence with keys;

an elastically deformable dome-like member having a flat top surface and disposed on said board section opposite one of said switches, for turning on and off said one switch;

a pair of first pivot bearing sections and a pair of first slide grooves formed on a top of said board section around said dome-like member;

a keytop disposed above said dome-like member and having top and bottom surfaces, a pair of second pivot bearing sections and a pair of second slide grooves formed in said bottom surface, said second slide grooves being open at one end;

first and second linkage members provided between said keytop and said board section in a one-to-one correspondence with said switches and having lower ends received in said first pivot bearing sections and said first slide grooves and having upper ends received in said second slide grooves and said second pivot bearing sections, respectively, said first and second linkage members being pivotally joined at intermediate portions thereof to form a pantograph; and press means disposed in contact with the flat top surface of said dome-like member substantially at a middle of one of said first and second linkage members, for press-deforming and releasing said dome-like member in response to the actuation and release of said keytop;

said pair of second slide grooves being open at the end thereof opposite to said second pivot bearing sections and closed at the other end with barrier walls so that when said keytop is at a top dead point, said barrier walls and said second pivot bearing sections formed on said bottom surface of said keytop are elastically gripped by upper end portions of said first and second linkage members due to the reaction force of said dome-like members;

a pair of lugs forming said pair of first slide grooves and barrier walls closing said first slide grooves at one end nearer to said first pivot bearing sections being formed in said board section, said first slide grooves being open at one end opposite to said first pivot bearing sections, guide slopes being formed at corners of said pair of lugs at said open ends so that studs extending from the lower ends of said second linkage member are guided into said first slide grooves.

2. A keyboard switch comprising:

a board section having switches formed in a one-to-one correspondence with keys;

an elastically deformable dome-like member having a flat top and disposed on said board section opposite one of said switches, for turning on and off said one switch;

said board section including a membrane sheet having said switches arranged therein; an elastic sheet laminated on said membrane sheet and having said dome-like member formed integrally therewith; and a housing of a resin material laminated on said elastic sheet and having a hole through which said dome-like member protrudes upward;

a pair of first pivot bearing sections and a pair of first slide grooves formed on a top of said board section around said dome-like member;

a keytop disposed above said dome-like member and having top and bottom surfaces, a pair of second pivot bearing sections and a pair of second slide grooves formed in said bottom surface, said second slide grooves being open at one end;

first and second linkage members provided between said keytop and said board section in a one-to-one correspondence with said switches and having lower ends received in said first pivot bearing sections and said first slide grooves and having upper ends received in said second slide grooves and said second pivot bearing sections, respectively, said first and second linkage members being pivotally joined at intermediate portions thereof to form a pantograph and press means disposed in contact with the flat top surface of said dome-like member substantially at a middle of one of said first and second linkage members, for press-deforming and releasing said dome-like member in response to the actuation and release of said keytop;

said pair of second slide grooves being open at the end thereof opposite to said second pivot bearing sections and closed at the other end with barrier walls so that when said keytop is at a top dead point, said barrier walls and said second pivot bearing sections formed on said bottom surface of said keytop are elastically gripped by upper portions of said first and second linkage members due to the reaction force of said dome-like member.

3. The keyboard switch of claim 2, wherein a peripheral wall is formed integrally with said housing on a top surface thereof so that it surrounds said dome-like member a little away therefrom.

4. The keyboard switch of claim 2, wherein said elastic sheet has an upward extended frame formed integrally therewith and surrounding said dome-like member and said housing has in an underside thereof a frame-shaped groove into which said extended frame is fitted to keep dust out.

5. The keyboard switch of claim 2, wherein said first pivot bearing sections and said first slide grooves are formed to a depth at least flush with the underside of said housing.

6. The keyboard switch of claim 2, wherein said first pivot bearing sections and said first slide grooves are formed to a depth at least flush with the underside of said elastic sheet.

7. A keyboard switch comprising:

a board section having switches formed in a one-to-one correspondence with keys;

an elastically deformable dome-like member having a flat top surface and disposed on said board section opposite one of said switches, for turning on and off said one switch;

a pair of first pivot bearing sections and a pair of first slide grooves formed on a top of said board section around said dome-like member;

a keytop disposed above said dome-like member and having top and bottom surfaces, a pair of second pivot bearing sections and a pair of second slide grooves formed in said bottom surface, said second slide grooves being open at one end;

first and second linkage members provided between said keytop and said board section in a one-to-one correspondence with said switches and having lower ends received in said first pivot bearing sections and said first slide grooves and having upper ends received in said second slide grooves and said second pivot bearing sections, respectively, said first and second linkage members being joined by a pivot at middle portions thereof in their lengthwise directions to form a pantograph, a front and back of each of said first and second linkage member being symmetrical with respect to a longitudinal axis line passing through the axis of the pivot so that said first and second linkage members can be assembled into a correct form even if they are assembled wrong side out;

press means disposed in contact with the flat top surface of said dome-like member substantially at a middle of one of said first and second linkage members, for press-deforming and releasing said dome-like member in response to the actuation and release of said keytop;

said pair of second slide grooves being open at the end thereof opposite to said second pivot bearing sections and closed at the other end with barrier walls so that when said keytop is at a top dead point, said barrier walls and said second pivot bearing sections formed on said bottom surface of said keytop are elastically gripped by upper end portions of said first and second linkage members due to the reaction force of said dome-like member.

8. A keyboard switch comprising:

a board section having switches formed in a one-to-one correspondence with keys;

an elastically deformable dome-like member having a flat top surface and disposed on said board section opposite one of said switches, for turning on and off said one switch, said top surface of said dome-like member being covered with a friction reducing layer;

a pair of first pivot bearing sections and a pair of first slide grooves formed on a top of said board section around said dome-like member;

a keytop disposed above said dome-like member and having top and bottom surfaces, a pair of second pivot bearing sections and a pair of second slide grooves formed in said bottom surface, said second slide grooves being open at one end;

first and second linkage members provided between said keytop and said board section in a one-to-one correspondence with said switches and having lower ends received in said first pivot bearing sections and said first slide grooves and having upper ends received in said second slide grooves and said second pivot bearing sections, respectively, said first and second linkage members being pivotally joined at intermediate portions thereof to form a pantograph; and press means disposed in contact with the flat top surface of said dome-like member substantially at a middle of one of said first and second linkage members, for press-deforming and releasing said dome-like member in response to the actuation and release of said keytop;

said pair of second slide grooves being open at the end thereof opposite to said second pivot bearing sections and closed at the other end with barrier walls so that when said keytop is at a top dead point, said barrier walls and said second pivot bearing sections formed on said bottom surface of said keytop are elastically gripped by upper end portions of said first and second linkage members due to the reaction force of said dome-like member.

9. The keyboard switch of claim 8, wherein said friction reducing layer is formed by a rigid material member.

10. The keyboard switch of claim 8, wherein said friction reducing layer is a lubricant layer coated on the top surface of said dome-like member.

11. The keyboard switch of claim 8, wherein said friction reducing layer is composed of a rigid material for providing rigidity in the top surface of said dome-like member and a lubricant layer coated over the top of said rigid material.

12. A keyboard switch comprising:

a board section having switches formed in a one-to-one correspondence with keys;

an elastically deformable dome-like member having a flat top surface and disposed on said board section opposite one of said switches, for turning on and off said one switch;

a square peripheral wall surrounding said dome-like member being formed on a top surface of said board section;

a pair of first pivot bearing sections and a pair of first slide grooves formed on said top surface of said board section around said dome-like member;

a keytop disposed above said dome-like member and having top and bottom surfaces, a pair of second pivot bearing sections and a pair of second slide grooves formed in said bottom surface, said second slide grooves being open at one end;

first and second linkage members provided between said keytop and said board section in a one-to-one correspondence with said switches and having lower ends received in said first pivot bearing sections and said first slide grooves and having upper ends received in said second slide grooves and said second pivot bearing sections, respectively, said first and second linkage members being pivotally joined at intermediate portions thereof to form a pantograph; and press means disposed in contact with the flat top surface of said dome-like member substantially at a middle of one of said first and second linkage members, for press-deforming and releasing said dome-like member in response to the actuation and release of said keytop;

said pair of second slide grooves being open at the end thereof opposite to said second pivot bearing sections and closed at the other end with barrier walls so that when said keytop is at a top dead point, said barrier walls and said second pivot bearing sections formed on said bottom surface of said keytop are elastically gripped by upper end portions of said first and second linkage members due to the reaction force of said dome-like member.

13. The keyboard switch of claim 12, wherein said first pair of pivot bearing sections and said first pair of slide grooves are formed in said square peripheral wall near its four corners.

* * * * *